US010180652B2

(12) United States Patent
Toda

(10) Patent No.: US 10,180,652 B2
(45) Date of Patent: Jan. 15, 2019

(54) DRAWER, ELECTRONIC APPARATUS INCORPORATING THE DRAWER, AND IMAGE FORMING APPARATUS INCORPORATING THE DRAWER

(71) Applicant: Yasuaki Toda, Tokyo (JP)

(72) Inventor: Yasuaki Toda, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/682,662

(22) Filed: Aug. 22, 2017

(65) Prior Publication Data

US 2018/0095417 A1 Apr. 5, 2018

(30) Foreign Application Priority Data

Sep. 30, 2016 (JP) ..... 2016-193661

(51) Int. Cl.

*G03G 15/00* (2006.01)
*G03G 21/16* (2006.01)
*G03G 21/18* (2006.01)

(52) U.S. Cl.

CPC ..... *G03G 21/1695* (2013.01); *G03G 21/1623* (2013.01); *G03G 21/1871* (2013.01); *G03G 15/6502* (2013.01); *G03G 2221/166* (2013.01); *G03G 2221/169* (2013.01); *G03G 2221/1684* (2013.01); *G03G 2221/1869* (2013.01)

(58) Field of Classification Search

CPC ..... G03G 21/1623; G03G 21/1661; G03G 21/1671; G03G 21/18; G03G 21/1839; G03G 21/1842; G03G 21/1846

USPC ..... 399/110, 111

See application file for complete search history.

(56) References Cited

U.S. PATENT DOCUMENTS

| | | | | |
|---|---|---|---|---|
| 9,533,846 | B2 * | 1/2017 | Ishii et al. ..... | G03G 21/1661 |
| 9,841,725 | B2 * | 12/2017 | Mushika et al. ... | G03G 21/1623 |
| 9,857,761 | B2 * | 1/2018 | Osawa et al. ..... | G03G 21/1661 |
| 2014/0167580 | A1 | 6/2014 | Funayama et al. | |
| 2014/0169828 | A1 | 6/2014 | Ohta et al. | |
| 2016/0221770 | A1 | 8/2016 | Ishii et al. | |

FOREIGN PATENT DOCUMENTS

| | | |
|---|---|---|
| JP | 2006-145892 | 6/2006 |
| JP | 2011-141380 | 7/2011 |
| JP | 2012-234034 | 11/2012 |

* cited by examiner

*Primary Examiner* — William J Royer

(74) *Attorney, Agent, or Firm* — Harness, Dickey & Pierce, P.L.C.

(57) ABSTRACT

A drawer, which is included in an electronic apparatus and an image forming apparatus, includes a drawing portion, a support shaft extending in a removing direction of the drawing portion, a handle at a downstream end of the support shaft, a locking portion at an upstream end of the support shaft, and a fixing member on the drawing portion. A rotation of the handle rotates the support shaft and the locking portion together between an unlocked state in which the drawing portion is fixed and a locked state in which the drawing portion is movable. The locking portion includes a fitting projection fitting to the fixing member in the locked state. The fitting projection includes a first wall extending from a root of the fitting projection, a second wall configured to contact the fixing member in the locked state, and a slanted portion inclined toward the removing direction.

6 Claims, 5 Drawing Sheets

DRAWER, ELECTRONIC APPARATUS INCORPORATING THE DRAWER, AND IMAGE FORMING APPARATUS INCORPORATING THE DRAWER

CROSS-REFERENCE TO RELATED APPLICATION

This patent application is based on and claims priority pursuant to 35 U.S.C. § 119(a) to Japanese Patent Application No. 2016-193661, filed on Sep. 30, 2016, in the Japan Patent Office, the entire disclosure of which is hereby incorporated by reference herein.

BACKGROUND

Technical Field

This disclosure relates to a drawer, an electronic apparatus incorporating the drawer, and an image forming apparatus incorporating the drawer.

Related Art

Electronic devices or apparatuses include a drawer or a drawing mechanism in an apparatus body thereof. The drawer is a unit supported by and detachably attached to the apparatus body so as to facilitate replacement of parts, for example.

In order to easily perform attachment and detachment of such a drawer to an electronic device or apparatus, the state of the drawer is switched with a switch or a lever between an unlocked state in which the drawer can be detached from or attached to the electronic device and a locked state in which the drawer cannot be detached from or attached to the electronic device.

SUMMARY

At least one aspect of this disclosure provides a drawer including a drawing portion, a support shaft, a handle, a locking portion, and a fixing member. The drawing portion is removably inserted to an apparatus housing in a predetermined removing direction. The support shaft is configured to extend through the drawing portion in the predetermined removing direction of the drawing portion. The handle is provided at a downstream end of the support shaft in the predetermined removing direction of the drawing portion. The locking portion is provided at an upstream end of the support shaft in the predetermined removing direction of the drawing portion. The fixing member is provided on the drawing portion. A rotation of the handle rotates the support shaft and the locking portion together and switches between an unlocked state in which the drawing portion is fixed without being removed from the apparatus housing and a locked state in which the drawing portion is removable from the apparatus housing. The locking portion includes a fitting projection configured to fit to the fixing member in the locked state. The fitting projection includes a first wall, a second wall, and a slanted portion. The first wall extends from a root of the fitting projection in the predetermined removing direction of the drawing portion. The second wall is configured to contact the fixing member in the locked state. The slanted portion is formed between the first wall and the second wall and inclined toward the predetermined removing direction of the drawing portion.

Further, at least one aspect of this disclosure provides an electronic apparatus including an apparatus housing, and the above-described drawer removably inserted to the apparatus housing.

Further, at least one aspect of this disclosure provides an image forming apparatus including an apparatus housing, and the above-described drawer removably inserted to the apparatus housing.

Further, at least one aspect of this disclosure provides an image forming apparatus including a process device including an image bearer configured to bear an image thereon, and the above-described drawer configured to remove the process device therefrom.

BRIEF DESCRIPTION OF THE SEVERAL VIEWS OF THE DRAWINGS

An exemplary embodiment of this disclosure will be described in detail based on the following figures, wherein.

DETAILED DESCRIPTION

Figure 1:
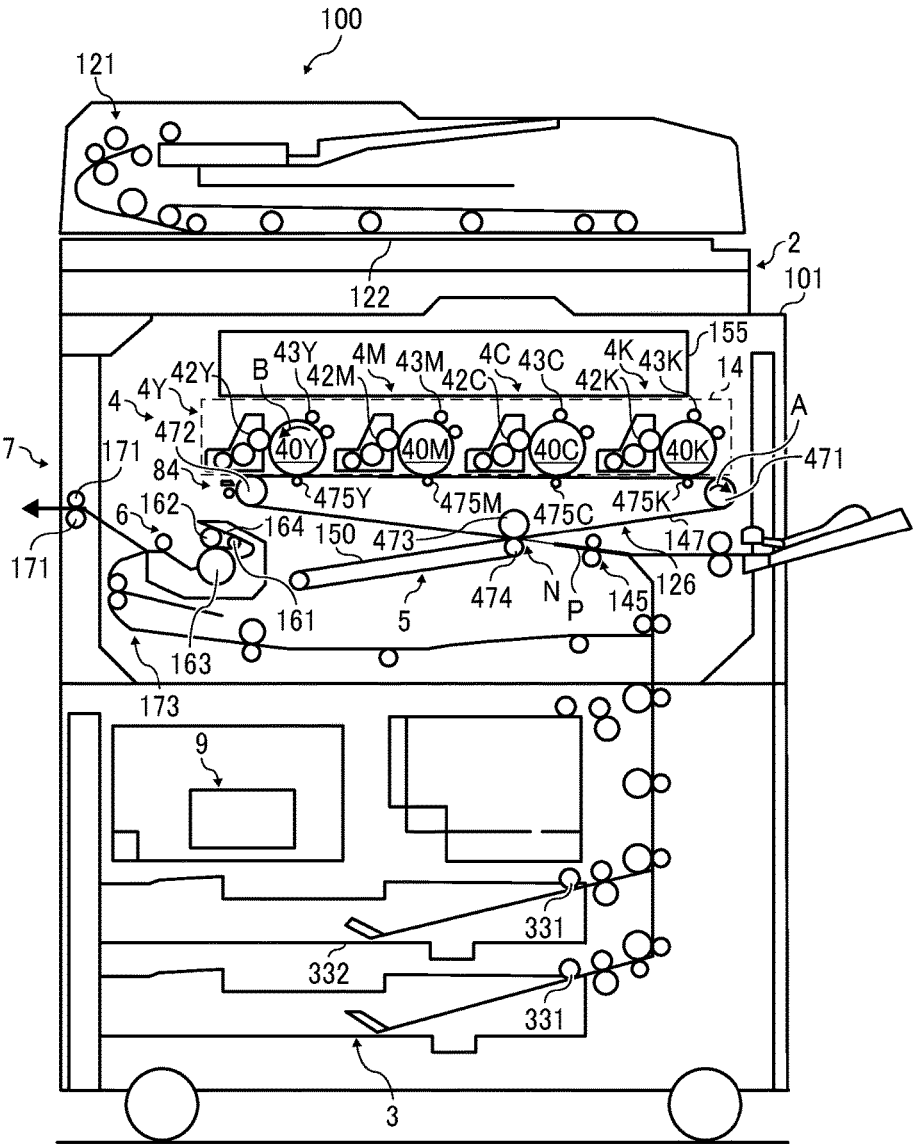
FIG. 1 is a plan view illustrating an exemplary configuration of an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of a device in use or operation in addition to the orientation depicted in the figures. For example, if the device in the figures is turned over, elements describes as "below" or "beneath" other elements or features would then be oriented "above" the other elements or features. Thus, a term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

FIG. 1 is a plan view illustrating an exemplary configuration of an exterior of an image forming apparatus 100 that functions as an electronic apparatus that includes a drawer according to the present embodiment of this disclosure.

It is to be noted that identical parts are given identical reference numerals and redundant descriptions are summarized or omitted accordingly.

An image forming system includes an image forming apparatus 100 and may be a copier, a facsimile machine, a printer, a multifunction peripheral or a multifunction printer (MFP) having at least one of copying, printing, scanning, facsimile, and plotter functions, or the like. According to the present example, the image forming apparatus 100 included in the image forming system 1 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and the like, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

As illustrated in FIG. 1, the image forming apparatus 100 includes an image forming device 4, a sheet feeding device 3, a reading device 2, an automatic document feeder 121, a primary transfer device 126, an optical scanning device 155, a secondary transfer device 5, and an intermediate transfer belt cleaning device 84.

The image forming device 4 includes process units 4Y, 4C, 4M, and 4K to form an image on a sheet P that functions as a recording medium.

The sheet feeding device 3 feeds the sheet P to the image forming device 4.

The reading device 2 functions as a scanner to read image data on an original document.

The automatic document feeder 121 (hereinafter, the ADF 121) automatically feeds an original document to the reading device 2.

The primary transfer device 126 functions as a primary transfer unit disposed in an apparatus housing 101 of the image forming apparatus 100. The primary transfer device 126 includes an intermediate transfer belt 147 that functions as a transfer body having an endless loop.

The optical scanning device 155 is disposed above the image forming device 4. The optical scanning device 155 functions as an optical writing unit and an exposure unit.

The secondary transfer device 5 functions as a secondary transfer unit to convey the sheet P and transfer a toner image on the intermediate transfer belt 147 onto the sheet P at a secondary transfer position N that functions as a nip region formed with the intermediate transfer belt 147.

The intermediate transfer belt cleaning device 84 cleans the intermediate transfer belt 147 after secondary transfer.

The image forming apparatus 100 further includes a pair of registration rollers 145, a fixing device 6, a sheet output portion 7, and an image formation controller 9.

The pair of registration rollers 145 conveys the sheet P fed from the sheet feeding device 3 to the secondary transfer position N at a predetermined timing.

The fixing device 6 fixes the toner image on the sheet P that has passed through the secondary transfer position N and conveyed thereto by the secondary transfer device 5, to the sheet P.

The sheet output portion 7 discharges the sheet P to the outside of the image forming apparatus 100 after the sheet P has passed through the fixing device 6 in which the toner image was fixed to the sheet P.

The image formation controller 9 functions as a controller that includes a central processing unit (CPU), a non-volatile memory, and a volatile memory. The image formation controller 9 controls movements of the CPU, the non-volatile memory, and the volatile memory.

The reading device 2 optically reads an original document conveyed by the ADF 121 and placed on an exposure glass 122, so as to generate RGB image data. Specifically, the reading device 2 reads RGB image data of an original document by emitting an optical light beam onto the original document and receiving the reflection light reflected on the original document by a reading sensor such as a charge coupled device (CCD) or a contact image sensor (CIS).

It is to be noted that the RGB image data indicates data of an image formed on the sheet P and includes brightness of each color of red (R), green (G), and blue (B).

The sheet feeding device 3 includes multiple sheet trays 332 and multiple sheet feed rollers 331. Each of the multiple sheet trays 332 accommodates the sheet P in the apparatus housing 101. Each of the multiple sheet feed rollers 331 forwards the sheet P accommodated in a corresponding one of the multiple sheet trays 332 toward the pair of registration rollers 145.

The process units 4Y, 4C, 4M, and 4K include drum-shaped photoconductors 40Y, 40C, 40M, and 40K, each of which functions as an image bearer and a rotary body to rotate in a counterclockwise direction in FIG. 1. Each of the photoconductors 40Y, 40C, 40M, and 40K includes a surface on which a photoconductive layer is formed. The photoconductive layer functions as a scanning target face onto which the optical scanning device 155 emits a scanning light beam.

The process units 4Y, 4C, 4M, and 4K include charging devices 43Y, 43C, 43M, and 43K, respectively. Each of the charging devices 43Y, 43C, 43M, and 43K is disposed close to a corresponding one of the process units 4Y, 4C, 4M, and 4K at an upstream side in a direction indicated by arrow B in FIG. 1. In other words, each charging device (i.e., the charging devices 43Y, 43C, 43M, and 43K) is located upstream from the optical scanning device 155 in the direction B in FIG. 1.

The process units 4Y, 4C, 4M, and 4K further include developing devices 42Y, 42C, 42M, and 42K and primary transfer rollers 475Y, 475C, 475M, and 475K, respectively. The primary transfer rollers 475Y, 475C 475M, and 475K are provided to the primary transfer device 126.

The primary transfer rollers 475Y, 475C 475M, and 475K contact the photoconductors 40Y, 40C, 40M, and 40K, respectively, forming a primary transfer nip region.

The process units 4Y, 4C, 4M, and 4K further include potential sensors, each of which is a surface potential detector that functions as a surface potential detector to detect a surface potential of each of the photoconductors 40Y, 40C, 40M, and 40K.

The process units 4Y, 4C, 4M, and 4K form respective latent images on the photoconductors 40Y, 40C, 40M, and 40K, respectively, so as to form yellow, cyan, magenta, and black toner images.

The intermediate transfer belt 147 includes polyimide resin that does not extend largely, and carbon particles dispersed to adjust the electrical resistance. The intermediate transfer belt 147 is wound and stretched by a drive roller 471, a driven roller 472, and a secondary transfer roller 473. The drive roller 471 is rotated by a drive source in a direction indicated by arrow A in FIG. 1. The driven roller 472 and the secondary transfer roller 473 are rotated in the same direction (i.e., the direction A) as the drive roller 471.

The secondary transfer device 5 includes a secondary transfer opposing roller 474 and a secondary transfer belt 150. The secondary transfer opposing roller 474 is disposed facing the secondary transfer roller 473. The secondary transfer belt 150 is wound and stretched by the secondary transfer opposing roller 474.

The secondary transfer belt 150 of the secondary transfer device 5 contacts the intermediate transfer belt 147 at the secondary transfer position N, forming a secondary transfer nip region.

In the secondary transfer device 5, the intermediate transfer belt 147 is nipped together with the sheet P at the secondary transfer position N between the secondary transfer belt 150 and the secondary transfer roller 473, where a secondary transfer bias is applied to transfer the toner image on the surface of the intermediate transfer belt 147 onto the sheet P.

At this time, the secondary transfer bias is a bias opposite to a static charge that is charged on the surface of the intermediate transfer belt 147.

After the secondary transfer at the secondary transfer position N, the secondary transfer belt 150 conveys the sheet P to the fixing device 6.

The fixing device 6 includes a heat roller 161, a fixing roller 162, and a fixing belt 164. The heat roller 161 includes a heat source therein. The fixing belt 164 is wound around the heat roller 161 and the fixing roller 162. The fixing device 6 further includes a pressure roller 163 that presses the fixing belt 164 that is pressed by the fixing roller 162, where a fixing nip region, which functions as a fixing portion corresponding to a pressing portion, is formed. The heat roller 161, the fixing belt 164, and the fixing roller 162 form a belt unit in which the fixing belt 164 rotates endlessly. By passing the sheet P through the fixing nip region, the fixing device 6 fixes the toner image formed on the surface of the sheet P to the sheet P by application of heat and pressure.

The heat roller 161 includes an aluminum cylindrical roller, a silicone rubber layer formed on the outer circumference of the cylindrical roller, and a halogen heater that functions as a heater disposed inside the cylindrical roller.

The sheet output portion 7 includes a pair of sheet output rollers 171 and a duplex printing unit 173. Rollers of the pair of sheet output rollers 171 are disposed facing each other. The duplex printing unit 173 reverses the sheet P to form images on both sides of the sheet P, and then conveys the sheet P to the pair of registration rollers 145.

In the present embodiment, the process units 4Y, 4C, 4M, and 4K form a process cartridge 14 that can pull out and remove the process units 4Y, 4C, 4M, and 4K, as a single unit, from the apparatus housing 101. In the following description, the process cartridge 14 is described to have a configuration that holds the process units 4Y, 4C, 4M, and 4K as a single unit to be freely removable from the apparatus housing 101. However, the configuration of the process cartridge 14 is not limited thereto.

Figure 2:
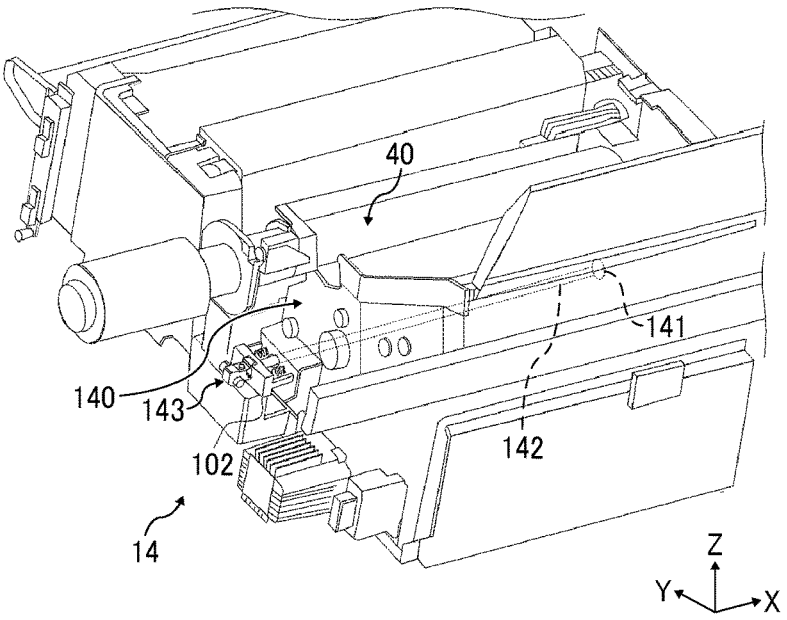
FIG. 2 is a diagram illustrating an exemplary configuration of a drawer included in the image forming apparatus of FIG. 1.
Figure 3:
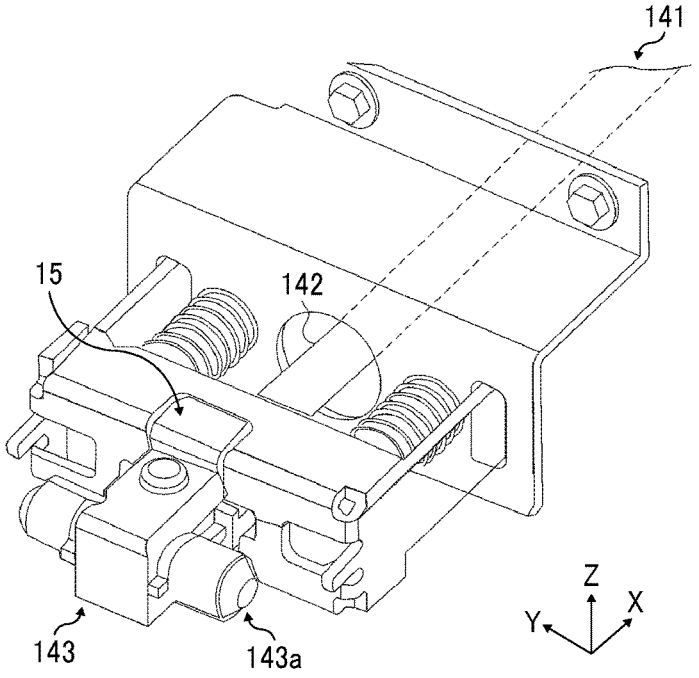
FIG. 3 is a diagram illustrating an exemplary configuration of the drawer according to this disclosure.

FIG. 2 is a diagram illustrating an exemplary configuration of a drawer included in the image forming apparatus 100 of FIG. 1. FIG. 3 is a diagram illustrating an exemplary configuration of the drawer according to this disclosure.

As illustrated in FIG. 2, the process cartridge 14 according to the present embodiment functions as a drawer that is removably inserted to and held by the apparatus housing 101 of the image forming apparatus 100. The process cartridge 14 includes the photoconductors 40Y, 40C, 40M, and 40K therein.

It is to be noted that, since the photoconductors 40Y, 40C, 40M, and 40K basically have the configurations identical to each other, except the colors of toners, a photoconductor 40 in FIG. 2 is illustrated without the suffixes indicating the respective colors.

As illustrated in FIGS. 2 and 3, the process cartridge 14 includes a drawing portion 140, a support shaft 142, a handle 141, a locking portion 143, and a fixing member 102.

The drawing portion 140 is removably inserted to the apparatus housing 101 of the image forming apparatus 100 along an X axis direction that is a predetermined removing direction of the drawing portion 140.

The support shaft 142 extends through the drawing portion 140 along the X axis direction.

The handle 141 is provided at a downstream end of the support shaft 142 in a removing direction of the drawing portion 140, which is at an end of the support shaft 142 in an X-axis positive direction.

The locking portion 143 is provided at an upstream end of the support shaft 142 in the removing direction of the drawing portion 140, which is at an end of the support shaft 142 in an X-axis negative direction.

The fixing member 102 is formed on a side plate of the drawing portion 140 so as to fit to the locking portion 143.

The handle 141 is an operation lever to rotate the support shaft 142 and the locking portion 143 together.

Figure 4A:
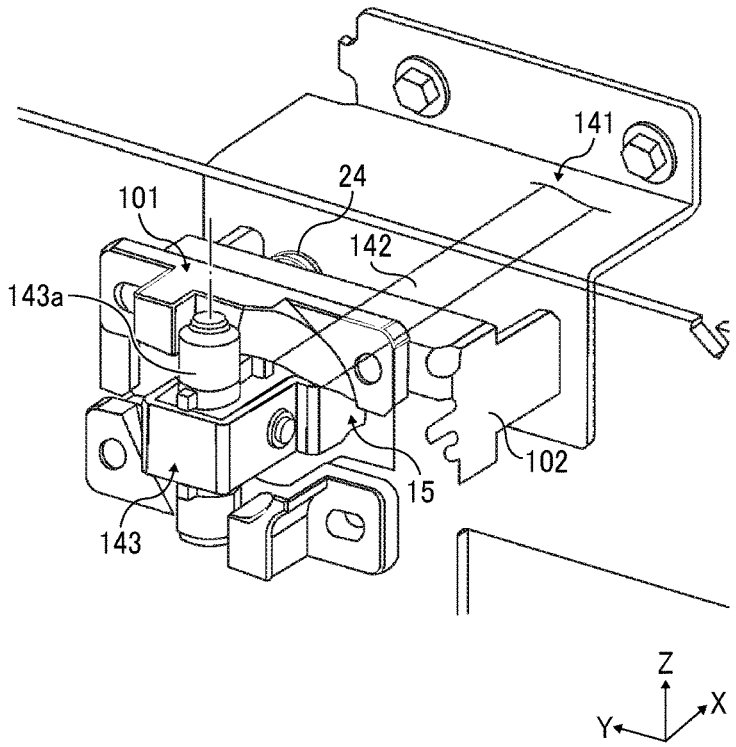
FIGS. 4A and 4B are diagrams illustrating exemplary movements of the drawer.
Figure 4B:
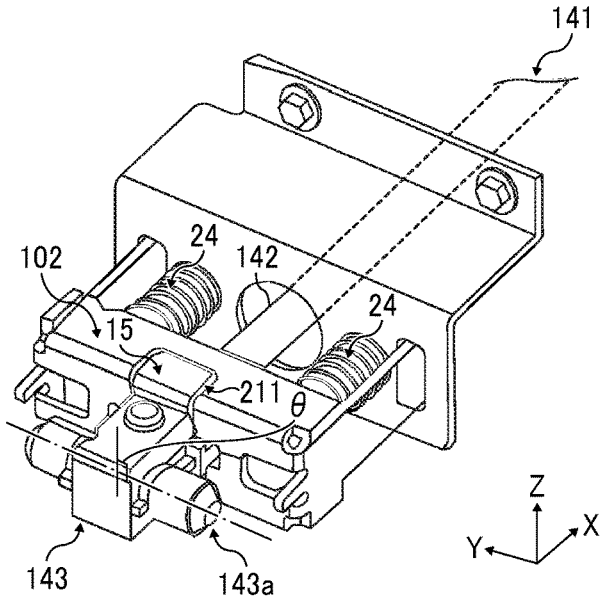

FIGS. 4A and 4B are diagrams illustrating exemplary movements of the process cartridge 14 that functions as a drawer.

By rotating the handle 141, the process cartridge 14 is switched between a locked state, in which the process cartridge 14 is fixed and cannot be removed from and inserted into the apparatus housing 101 of the image forming apparatus 100, as illustrated in FIG. 4A and an unlocked state, which is a regular state in which the process cartridge 14 can be removed from and inserted into the apparatus housing 101 of the image forming apparatus 100, as illustrated in FIG. 4B. Specifically, when the process cartridge 14 is switched to the locked state, the process cartridge 14 is fixed to the apparatus housing 101, as illustrated in FIG. 4A. By contrast, when the process cartridge 14 is switched to the unlocked state, the process cartridge 14 can be pulled out from the apparatus housing 101, as illustrated in FIG. 4B.

The support shaft 142 is a shaft that extends in the removing direction of the process cartridge 14, that is, in the X axis direction in the present embodiment, and has the handle 141 at one end thereof in the X-axis positive direction and the locking portion 143 at the other end thereof in the X-axis negative direction.

The locking portion 143 includes a fixed shaft 143*a* and a fitting projection 15.

The fixed shaft 143*a* extends in a Z axis direction so as to contact the apparatus housing 101 to regulate movement of the process cartridge 14 in the locked state.

The fitting projection 15 fits to the fixing member 102 in the unlocked state.

As described above, FIGS. 4A and 4B are diagrams illustrating the movements of the drawer (i.e., the process cartridge 14 in the present embodiment). As clearly seen from FIGS. 4A and 4B, the fixed shaft 143*a* and the fitting projection 15 are disposed apart from each other at an angle of 90 degrees when the locking portion 143 is rotated about the support shaft 142. That is, when the process cartridge 14 is in the locked state as illustrated in FIG. 4A and a rotation angle θ of the fixed shaft 143*a* is 0 degree, the fitting projection 15 is provided at a position where the rotation angle θ is 90 degrees.

It is to be noted that movement of the process cartridge 14 is regulated in the Z axis direction in the locked state by causing the locking portion 143 to contact the apparatus housing 101.

The fixing member 102 includes a cut opening 211. The cut opening 211 restrains rotation of the support shaft 142 in the unlocked state by fitting to the fitting projection 15.

Now, a description is given of movement of the process cartridge 14 when removing the process cartridge 14 that is removably inserted into the apparatus housing 101.

First, a user grabs and holds the handle 141 and rotates the handle 141 by 90 degrees in a clockwise direction, so that the state of the process cartridge 14 changes from the locked state to the unlocked state.

In the unlocked state, the fixed shaft 143*a* is disengaged from the apparatus housing 101. By so doing, the process cartridge 14 comes to be freely movable in the X axis direction.

In a comparative image forming apparatus, in order to prevent unintentional switching between the locked state and the unlocked state of a process cartridge, a support shaft such as the support shaft 142 is held so as not to rotate in the unlocked state of the process cartridge.

In addition, in a case in which a rotary body such as the photoconductors 40Y, 40C, 40M, and 40K unintentionally rotates when the process cartridge is pulled out from an apparatus housing of the comparative image forming apparatus, it is likely to interfere with the apparatus housing when the process cartridge is attached again to the image forming apparatus or to cause positional shift or misalignment.

In order to address the above-described inconvenience, the process cartridge 14 according to the present embodiment includes the fitting projection 15 that fits to the fixing member 102 in the unlocked state.

A description is given of the movement of the fitting projection 15 and parts associated with the movement of the fitting projection 15.

Figure 5:
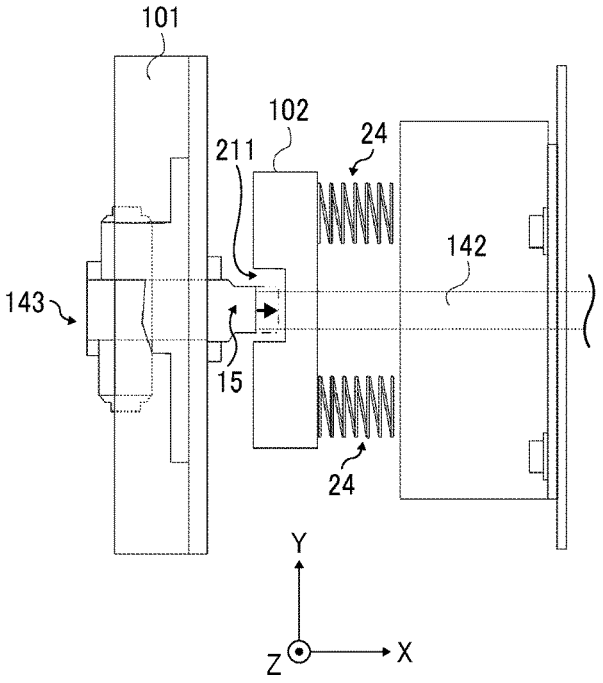
FIG. 5 is a cross sectional view illustrating movement of a fitting projection during the movements of the drawer of FIGS. 4A and 4B.
Figure 6:
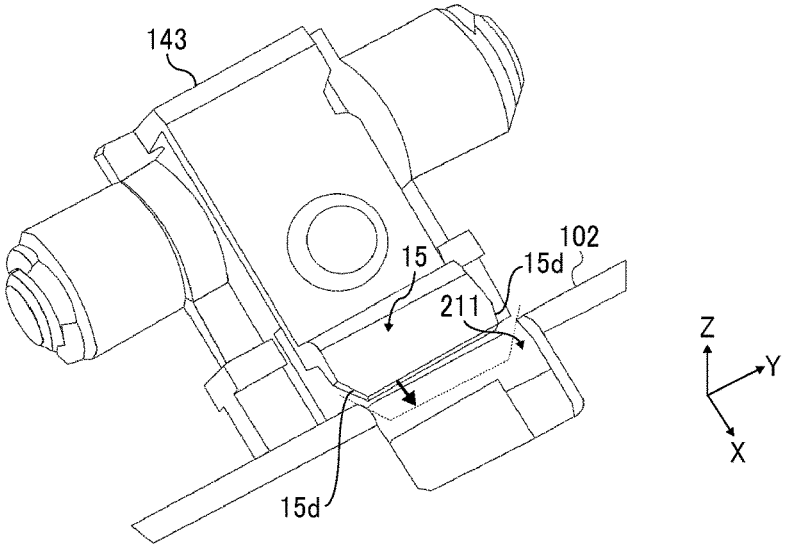
FIG. 6 is a diagram illustrating a configuration of a comparative drawer.
Figure 7:
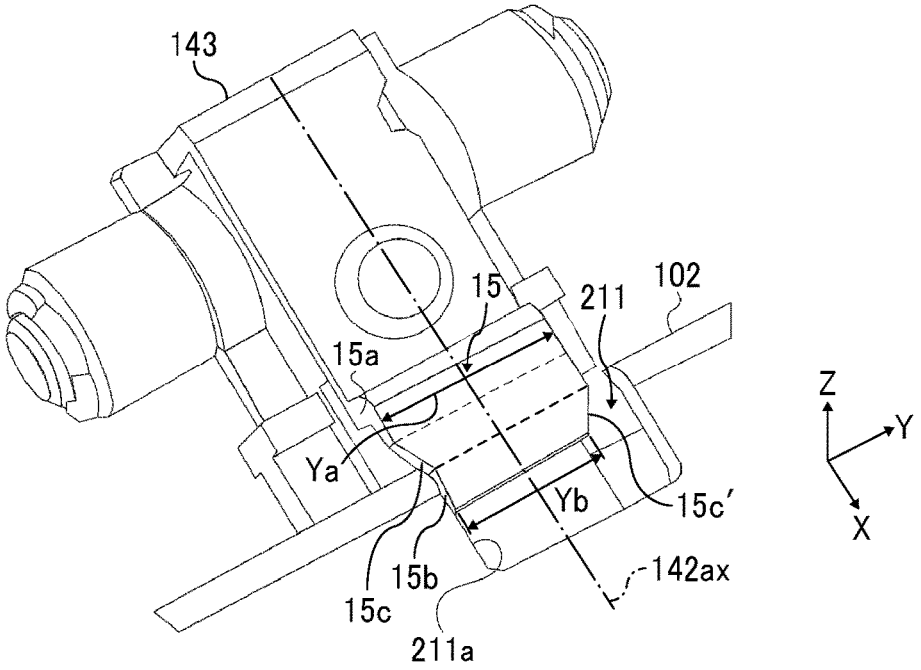
FIG. 7 is a diagram illustrating a configuration of the fitting projection according to the present embodiment of this disclosure.

FIG. 5 is a cross sectional view illustrating movement of a fitting projection during the movements of the drawer of FIGS. 4A and 4B. FIG. 6 is a diagram illustrating a configuration of a comparative drawer. FIG. 7 is a diagram illustrating a configuration of the fitting projection 15 according to the present embodiment of this disclosure.

In FIG. 5, the locking portion 143 is viewed from a Z-axis positive direction, immediately after the handle 141 has been rotated to the state illustrated in FIG. 4B.

At this time, as the process cartridge 14 is pulled out in the X-axis positive direction, the locking portion 143 also moves to the right direction of FIG. 5.

The fixing member 102 is biased by springs 24 in the X-axis negative direction, and therefore stays at the same position.

As described above, while the fixing member 102 stays at the same position, the fitting projection 15 moves in the X-axis positive direction. Consequently, the fitting projection 15 is engaged with the fixing member 102, as indicated by broken lines in FIG. 5.

Accordingly, in order to cause the fitting projection 15 and the fixing member 102 to be smoothly engaged with each other, the fitting projection 15 of the comparative drawer includes slanted portions 15*d* at both ends of a leading end portion, as illustrated in FIG. 6. By so doing, the fitting projection 15 can be smoothly engaged with the cut opening 211 of the fixing member 102.

However, it is likely that the slanted portions 15*d* at both ends of the leading end portion of the fitting projection 15 are incompletely engaged with the cut opening 211 of the fixing member 102, as illustrated in a dotted line in FIG. 6. Therefore, the fitting projection 15 of the comparative drawer is not likely to be inserted into the cut opening 211 properly.

By contrast, as illustrated in FIG. 7, the fitting projection 15 of the present embodiment includes a first straight portion 15*a* and a second straight portion 15*b*. The first straight portion 15*a* functions as a first wall that extends from a root side of the fitting projection 15 in the X axis direction. The second straight portion 15*b* functions as a second wall that contacts the fixing member 102 in the locked state.

Further, in the present embodiment, the fitting projection 15 further includes a first slanted portion 15*c* that is formed between the first straight portion 15*a* and the second straight portion 15*b* and is inclined toward the X axis direction.

According to this configuration, even when the cut opening 211 and the first slanted portion 15*c* collide with each other, the second straight portion 15*b* contacts a wall face 211*a* of the cut opening 211. Therefore, the support shaft 142 does not rotate unintentionally.

Further, in the present embodiment, a width Ya of the first straight portion 15*a* in a Y axis direction is greater than a width Yb of the second straight portion 15*b* in the Y axis direction. In other words, the first straight portion 15*a* is disposed more outward than the second straight portion 15*b* from a central axis 142*ax* of the support shaft 142.

According to this configuration, the second straight portion 15*b* can enter the cut opening 211 more easily, and therefore an unintentional rotation of the support shaft 142 can be restrained.

Further, in the present embodiment, a length in the Z axis direction of the second straight portion 15*b* that is formed on a side of the wall face 211*a* of the cut opening 211 is formed to be equal to a length in the Z axis direction of the wall face 211*a* of the cut opening 211.

According to this configuration, the end portion of the cut opening 211 just contacts the first slanted portion 15*c*, and therefore part of a biasing force exerted by the springs 24 in the X axis direction becomes a force to press the locking portion 143 to the Y axis direction. That is, the fitting projection 15 can easily be fitted to the cut opening 211. Therefore, the second straight portion 15*b* can easily enter into the cut opening 211, and an unintentionally rotation of the support shaft 142 can be restrained.

Further, the configuration of the present embodiment includes multiple slanted portions, i.e., the first slanted portion 15*c* and a second slanted portion 15*c*'. In the present embodiment, the first slanted portion 15*c* that is provided on the wall (of one side) in a Y-axis positive direction is formed at a position different from the second slanted portion 15*c*' that is provided on the wall (of an opposing side) in a Y-axis negative direction in the X axis direction. In other words, the first slanted portion 15*c* is formed on one side of the fitting projection 15 and the second slanted portion 15*c*' is formed on an opposing side that is located opposite to the one side of the fitting projection 15.

According to this configuration, when the process cartridge 14 is inserted into the apparatus housing 101 of the image forming apparatus 100 again, a clearance can be provided reliably. Accordingly, breakage or wear of the fixing member 102 can be prevented.

Although this disclosure has been described in detail with reference to an illustrative embodiment and application, those skilled in the art will appreciate that various modifications and variations may be made without departing from the intended scope of this disclosure as defined in the appended claims.

The electronic apparatus according to this disclosure has been discussed above as an image forming apparatus such as a copier, a facsimile machine, a printer, a plotter, a multifunction peripheral or a multifunction printer (MFP) having at least one of copying, printing, scanning, facsimile, and plotter functions, or the like. However, the electronic apparatus may be another apparatus or device such as a home appliance and a medical equipment.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A drawer comprising:

a drawing portion removably inserted to an apparatus housing of an electronic apparatus in a predetermined removing direction;

a support shaft configured to extend through the drawing portion in the predetermined removing direction of the drawing portion;

a handle provided at a downstream end of the support shaft in the predetermined removing direction of the drawing portion;

a locking portion provided at an upstream end of the support shaft in the predetermined removing direction of the drawing portion; and a fixing member provided on the drawing portion, a rotation of the handle rotating the support shaft and the locking portion together and switching between an unlocked state in which the drawing portion is fixed without being removed from the apparatus housing of the electronic apparatus and a locked state in which the drawing portion is removable from the apparatus housing of the electronic apparatus, the locking portion including a fitting projection configured to fit to the fixing member in the locked state, the fitting projection including, a first wall extending from a root of the fitting projection in the predetermined removing direction of the drawing portion;

a second wall configured to contact the fixing member in the locked state; and a slanted portion formed between the first wall and the second wall and inclined toward the predetermined removing direction of the drawing portion.

2. The drawer according to claim 1, wherein the first wall is disposed more outward than the second wall from a central axis of the support shaft.

3. The drawer according to claim 2, wherein the slanted portion includes a first slanted portion formed on one side of the fitting projection, wherein the fitting projection further includes a second slanted portion at a leading end thereof on an opposing side to the first slanted portion, and wherein the first slanted portion is formed at a position different from the second slanted portion in the predetermined removing direction of the drawing portion.

4. The drawer according to claim 1, wherein the slanted portion includes a first slanted portion on one side of the fitting projection and a second slanted portion on an opposing side of the fitting projection, and wherein the first slanted portion is formed at a position different from the second slanted portion in the predetermined removing direction of the drawing portion.

5. An image forming apparatus comprising:

the drawer according to claim 1, the drawer removably inserted to the apparatus housing.

6. An image forming apparatus comprising:

a process device including an image bearer configured to bear an image thereon; and the drawer according to claim 1, the drawer configured to remove the process device therefrom.

* * * * *